US008245544B2

(12) United States Patent
Lonati et al.

(10) Patent No.: US 8,245,544 B2
(45) Date of Patent: Aug. 21, 2012

(54) CIRCULAR KNITTING MACHINE FOR MEN'S SOCKS, OF THE TYPE WITH NEEDLES ON THE DIAL

(75) Inventors: Ettore Lonati, Brescia (IT); Tiberio Lonati, Brescia (IT); Fausto Lonati, Brescia (IT)

(73) Assignee: Santoni, S.p.A., Brescia (IT)

( * ) Notice: Subject to any disclaimer, the term of this patent is extended or adjusted under 35 U.S.C. 154(b) by 0 days.

(21) Appl. No.: 13/322,191

(22) PCT Filed: Jul. 5, 2010

(86) PCT No.: PCT/IB2010/053072

§ 371 (c)(1),
(2), (4) Date: Nov. 23, 2011

(87) PCT Pub. No.: WO2011/004310

PCT Pub. Date: Jan. 13, 2011

(65) Prior Publication Data

US 2012/0103024 A1 May 3, 2012

(30) Foreign Application Priority Data

Jul. 8, 2009 (IT) ..... BS2009A0132

(51) Int. Cl.
*D04B 15/18* (2006.01)

(52) U.S. Cl. ..... 66/31; 66/216

(58) Field of Classification Search ..... 66/19, 20, 66/31, 32, 33, 216, 75.1, 215
See application file for complete search history.

(56) References Cited

U.S. PATENT DOCUMENTS

| | | | | |
|---|---|---|---|---|
| 2,153,019 | A * | 4/1939 | Holmes | 66/24 |
| 2,391,665 | A * | 12/1945 | Wildt et al. | 66/24 |
| 4,040,273 | A | 8/1977 | Bonazzi | |
| 4,539,825 | A | 9/1985 | Colosio | |
| 5,386,711 | A * | 2/1995 | Chen | 66/19 |
| 6,101,848 | A * | 8/2000 | Wang | 66/31 |
| 2010/0192637 | A1 | 8/2010 | Lonati | |

FOREIGN PATENT DOCUMENTS

| | | |
|---|---|---|
| DE | 2117125 A1 | 10/1971 |
| GB | 1377141 A | 12/1974 |

OTHER PUBLICATIONS

International Search Report and Written Opinion of the ISA for PCT/IB2010/053072, ISA/EP, Rijwsijk, NL, mailed Feb. 10, 2011.

* cited by examiner

*Primary Examiner* — Danny Worrell
(74) *Attorney, Agent, or Firm* — Harness, Dickey & Pierce, PLC

(57) ABSTRACT

A circular knitting machine for men's socks comprises a cylinder, cylinder needles, movement devices of the cylinder needles, sinkers (12), movement devices of the sinkers, a dial (14), a dial shaft, dial needles (18) mechanisms for moving the dial needles, selector mechanism able to selectively move the dial needles, a yarn-finger, dial needle selector mechanisms. The dial needle selector mechanisms comprise selector rods (30) limited in both directions radially to the respective dial needles.

10 Claims, 9 Drawing Sheets

CIRCULAR KNITTING MACHINE FOR MEN'S SOCKS, OF THE TYPE WITH NEEDLES ON THE DIAL

CROSS-REFERENCE TO RELATED APPLICATIONS

This application is a 371 U.S. National Stage of International Application No. PCT/IB2010/053072, filed Jul. 5, 2010. This application claims priority to Italian Patent Application No. BS2009A000132, filed Jul. 8, 2009. The disclosures of the above applications are incorporated herein by reference.

The present invention relates to a circular knitting machine for men's socks, of the type with needles on the dial.

As is known, circular knitting machines for men's socks can be divided into two main categories: those with single-cylinders and those with double cylinders.

The former have a simpler functioning system and lower production and maintenance costs, but cannot reproduce some types of stitch, unlike the double cylinder machines.

The single cylinder machine with needles on the dial performs a broader range of machining compared to the simple single cylinder machine, without however enabling all the types of machining possible with the double cylinder machine.

However, there are some types of production, such as those involving the production of a knitted fabric with multicolour decorative patterns, which require cutting of the coloured yarns, only possible on the single cylinder machines, inasmuch as fitted with a cutter above the cylinder.

One embodiment is described in the International Patent Application WO 2009/013773 in the name of the Applicant.

Such machines have a large number of needles on the dial and it is therefore proves particularly difficult to select them for the machining in a simple and accurate manner.

The purpose of the present invention is to create a circular knitting machine for men's socks, with needles on the dial, which makes it possible to simply and accurately select the needles on the dial.

Such purpose is achieved by a single cylinder machine with needles on the dial, made according to claim 1. The dependent claims describe embodiment variations.

The characteristics and advantages of the machine according to the present invention will be evident from the description given below, made by way of an illustrative and non-limiting example, in accordance with the attached figures, wherein.

Figure 5B:
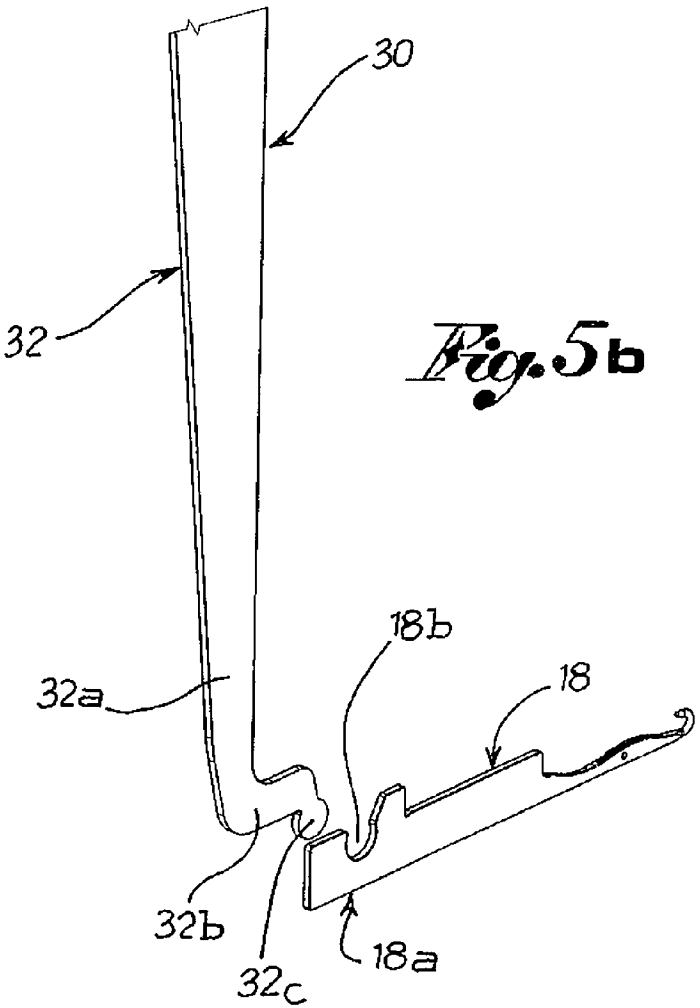
Figure 5A:
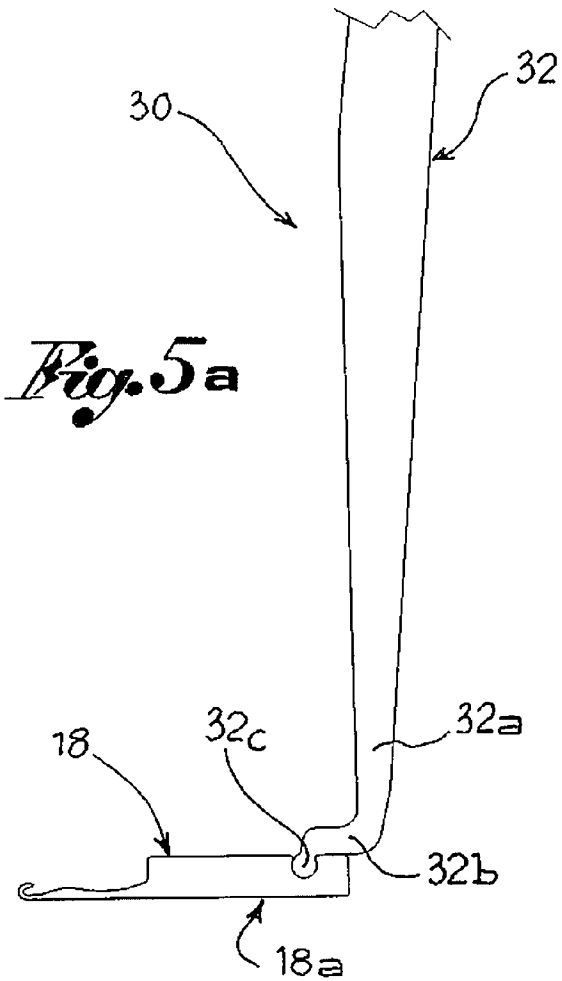

FIGS. 4*a* to 4*f* show a sequence of machine processes of the machine according to the present invention, in a further embodiment variation, able to repeatedly perform, during the production of a single sock, the transfer of the stitch from the cylinder to the dial;

FIGS. 5*a* and 5*b* show an enlargement of a preferred embodiment of the selector mechanism according to the present invention;

With reference to the attached figures, reference numeral 1 globally denotes a circular knitting machine for the production of men's socks.

The term "machine for men's socks" is taken to mean a type of machine for hosiery able to produce articles in which the proportion of the nominal diameter of the threads or yarns used and the dimensions of the stitch is such as to produce a knitted fabric with a high level of coverage, in other words with the opposite characteristic to the sheerness of traditional ladies' stockings. In other words, the wording "men's socks" refers in actual fact to an intrinsic characteristic of the article produced and not to the effective use made of the same.

The machine 1 comprises a cylinder 2, hollow on the inside, having a rotation axis X, rotating in a manner that can be controlled around said axis, and having a plurality of axial grooves 4 on its external surface.

Furthermore, the machine 1 comprises a plurality of cylinder needles 6, held so that they can slide along the axial grooves 4 of the cylinder 2.

In addition, the machine 1 comprises a drum (not shown), coaxial to the cylinder 2 and situated externally to it, which can be made to rotate around the cylinder.

Furthermore, the machine 1 comprises a mechanism for moving the cylinder needles, able to impose translation in alternate directions on the cylinder needles 6 between a lower limit position and an upper limit position, axially higher than the lower limit position.

The movement mechanism comprises a plurality of cams, joined to the drum, fitted with active surfaces which, engaging sufficiently with the cylinder needles, cause it to rise and/or lower as needed.

Furthermore, the machine 1 comprises a fixed external crown 8, which surrounds the cylinder 2, coaxial with it, fitted with a plurality of crown grooves 10, positioned radially in relation to the rotation axis X.

The machine 1 comprises, in addition, a plurality of sinkers 12, held so that they can slide along the crown grooves 10 and relative mechanisms for moving the sinkers, able to impose translation of the sinkers in alternate directions between a rearward limit position and a forward limit position, radially internal to the rearward limit position.

The machine 1 also comprises a dial 14, positioned so as to surmount the cylinder 2, coaxial with it and which can be made to rotate around the rotation axis X of the cylinder 2.

Specifically, the machine 1 comprises a dial shaft 15, which extends along the rotation axis X and surmounts the dial 14, joined to a lower extremity of said dial 14, so as to move it in rotation, and engaged with motorised means at the other extremity.

The dial 14 is fitted with a plurality of radial grooves 16, which extend radially, remaining inside the imaginary axial prolongation of the external surface of the cylinder 2, as well as a plurality of dial needles 18, for example in the same number as the cylinder needles, held so that they can slide along the radial grooves 16 of the dial 14.

Furthermore, the machine 1 comprises a mechanism for moving the dial needles, which can engage with said dial needles and able to impose a translation of the dial needles in alternate directions, between a rearward limit position and a forward limit position, radially external to the rearward limit position.

For example, the machine 1 comprises an annular cover 20, positioned above the dial 14, coaxial with it and fixed; the mechanism for moving the dial needles comprises a plurality of cams 22, joined to the cover 20, so that, by turning the dial, said cams 22 engage the dial needles imposing their radial translation.

The machine 1 comprises, in addition, at least one yarn-finger (not shown) able to feed at least one yarn for the production of the sock.

The cylinder needles 6, the dial needles 18 and the sinkers 12 work together to interlace the yarn and form the stitches which constitute the sock.

Furthermore, the machine 1 comprises dial needle selectors, able to selectively move the dial needles to translate them from a disengaged position to an engaged position, in which they can be engaged by said mechanisms for moving the dial needles, involving the selected needles in the formation of the stitches and excluding the needles not selected.

In other words, the mechanisms for moving the dial needles only have an active function when the dial needles, and specifically the heels of the same, are situated outside a predetermined radial position, defined engagement position; when the dial needles, that is the heels of such, are radially positioned inside said predetermined radial position however, the mechanisms for moving the dial needles are inactive, in other words cannot engage the dial needles.

The dial needle selectors are able to selectively translate (that is only some or all) the dial needles 18, so that the selected needles can be engaged by the mechanisms for moving the dial needles.

According to a preferred embodiment, the selectors comprise a plurality of selector rods 30 oscillating upon command, which can engage with the dial needles 18 so as to select some of them.

Said rods 30, preferably in the same number as the number of the dial needles, surmount the cylinder 2 and the dial and are arranged in a ring around the rotation axis X of the cylinder 2.

Preferably, the rods 30 comprise an engagement section 32, terminating in an engagement extremity 32*a* which can engage with at least one of said dial needles 18.

The rods 30 are engaged with the dial needles 18 by a mechanical constraint, preferably in two directions in a radial direction (FIGS. 5*a* and 5*b*).

Preferably, the engagement extremity 32*a* comprises a tail 32*b*, on a plane with the engagement section 32 of the rod 30, projecting internally radially, that is towards the dial needle 18.

The tail 32*b* comprises, in addition, a disc 32*c*, lying on the plane of the rod, positioned at the end of it, shaped externally in a circular manner, as far as the connection with the body of the tail 32*b*.

The heel 18*a* of the dial needle 18, which engages with the rod 30, has a heel seat 18*b* able to house a portion of the engagement extremity 32 of the rod 30, and, in particular, able to hold the disc 32*c* of the tail 32*b*.

The disc 32*c* is able to rotate inside the heel seat 18*b* around a tangential direction, that is, a direction orthogonal to the radial direction.

Consequently, the engagement extremity 32 of the rod 30 is hinged to the dial needle, so that said dial needle 18 is constrained in radial translation at the extremity of the rod 30, but rotationally unconstrained by it.

The annular uptwister 20, positioned above the dial 14, has an aperture 20*a* used specifically by the engagement extremity 32 to extend as far as the dial needle, that is with the heel of the same.

Figure 1:
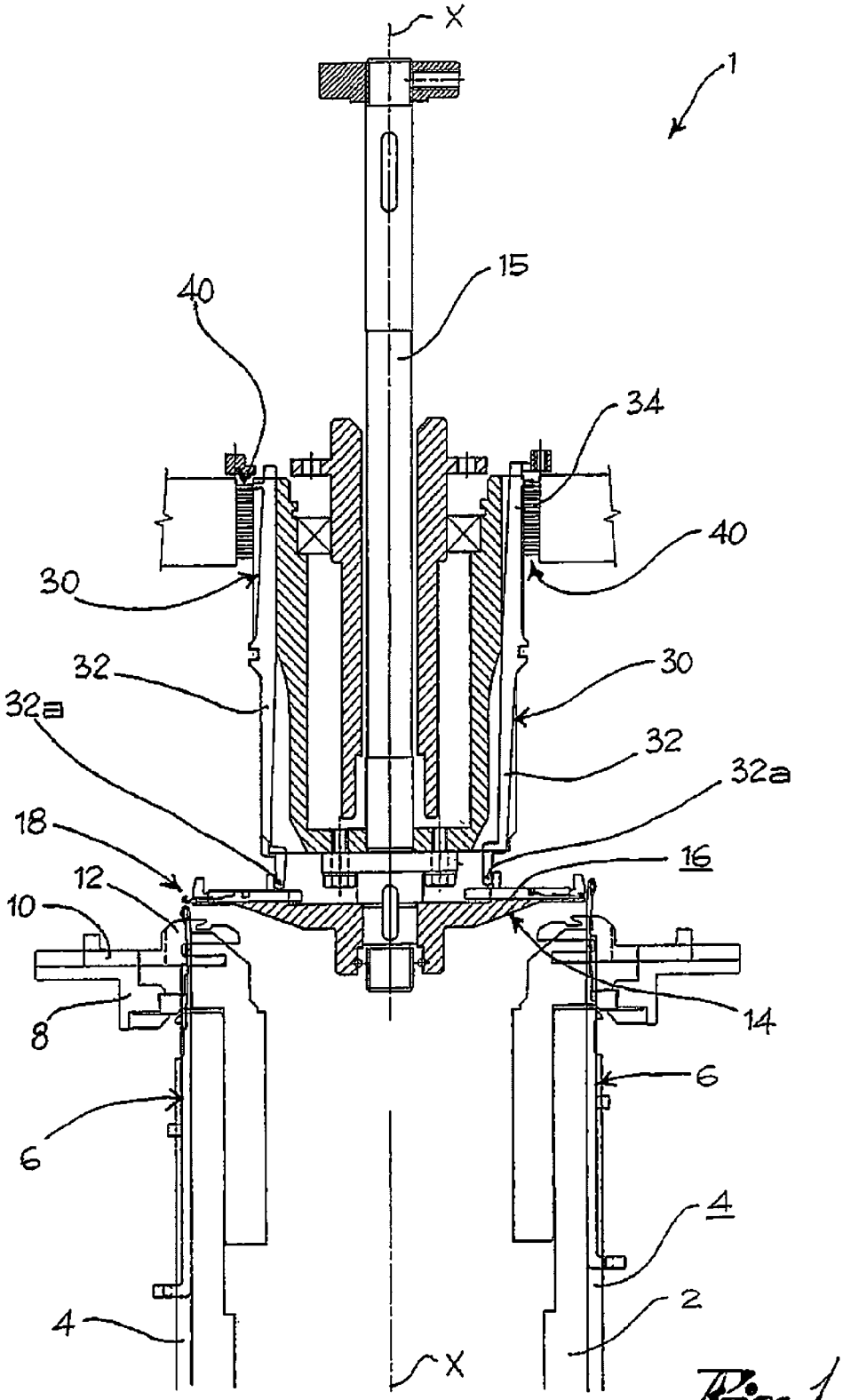
FIG. 1 shows a cross-section of a machine according to an embodiment variation of the present invention.
Figure 2:
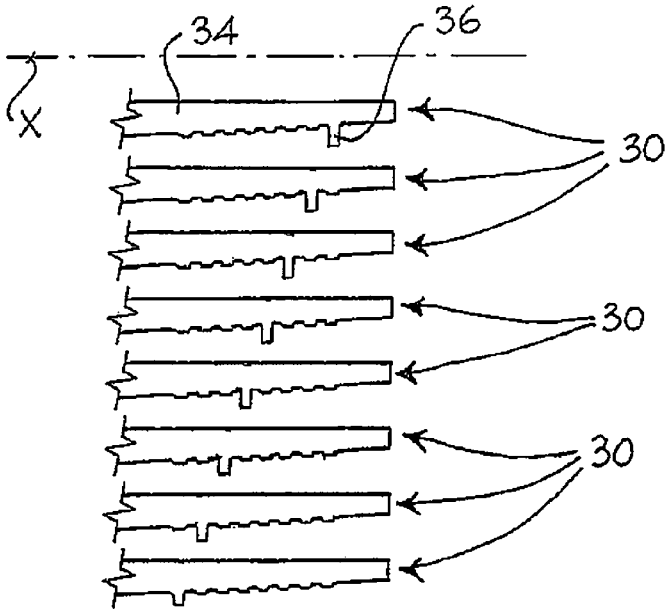
FIG. 2 shows a representative diagram of the extremities of the selector rods of the machine in FIG. 1.
Figure 3:
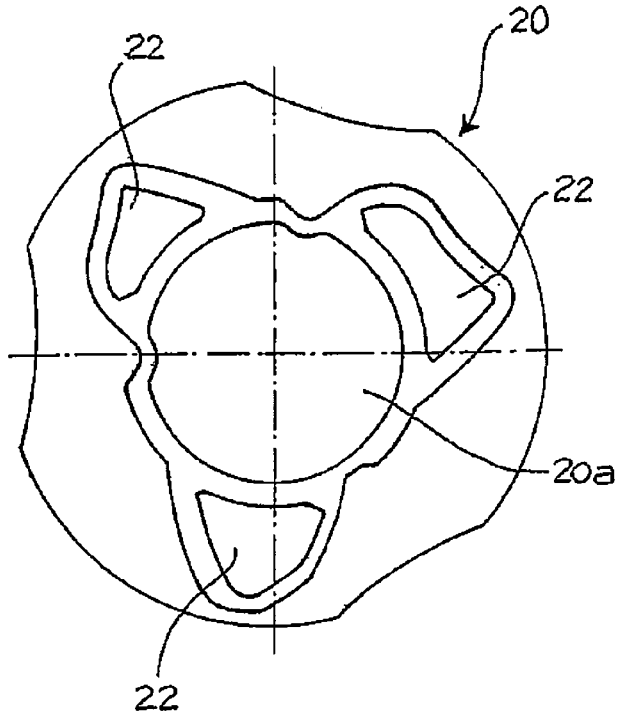
FIG. 3 shows a view of an uptwister of the machine in FIG. 1, comprising a mechanism for moving the dial needles.

Furthermore, the rod 30 comprises a command section 34, connected to the engagement section 32. The command section 34 of each rod 30 comprises a boss 36 projecting externally in relation to the rotation axis X of the cylinder 2; the bosses 36 of the rods 30, when compared to each other, are reciprocally staggered, for example axially (FIG. 2).

Preferably, in addition, the selectors comprise selection command devices able to selectively move at least one of said rods 30, so as to select the corresponding dial needle.

For example, the selection command devices comprise a plurality of actuator levers 40, which can be selectively commanded to protrude, axially staggered like the bosses 36 of the levers 30, engaging the boss 36 of one of said rods 30, to make it oscillate and selecting the respective dial needle.

Preferably, in addition, the dial needles 18 comprise a machining section for the creation of the stitch and a moving section, which can engage with the mechanisms for moving the dial needles.

According to one embodiment variation, the moving sections of the dial needles are staggered axially, for example at two different heights, so as to enable the radial arrangement on the dial of a number of dial needles the same as the number of cylinder needles.

Preferably, in addition, the machine 1 comprises a cutting device, positioned on the uptwister 20, able to cut the yarn.

According to a further embodiment variation, the cylinder needles 6 comprise a) a spindle 50 extending mainly along the rotation axis X, between a lower extremity 50*a* (heel), which can be influenced by the mechanism for moving the cylinder needles, and an upper extremity 50*b*, which can engage with the dial needles 18 and the sinkers 12 to form the stitch;

b) a hook and a tab at the upper extremity 50*b* of the spindle; the tab is pivoted on the spindle 50 at a hinging point, so as to be reclosable onto the hook to form the space for the yarn;

c) a transfer boss 60, projecting externally from the spindle 50, positioned below the hinging point of the tab, able to engage a stitch in the movement between a lower limit position and an upper limit position.

The transfer boss 60 is positioned along the spindle 50 in such a way that, in the upper limit position of the cylinder needle, said transfer boss is above the machining extremity of the dial needle 18 (FIG. 4*d*), to enable the transfer of the stitch from the cylinder 2 to the dial 14.

Preferably, the cylinder needle 6 has a first heel 50*b*, at the lower extremity of the spindle, and a second heel 50*c*, between the first heel 50*b* and the transfer boss 60, able to be engaged by the mechanisms for moving the cylinder needles to bring the cylinder needle 6 to the upper limit position, and raise it to an optimal position for the transfer of the stitch from the cylinder needle to the dial needle.

Preferably, in addition, the mechanisms for moving the cylinder needles comprises at least one jack, positioned in the respective axial groove 4 of the cylinder 2, below the respective cylinder needle 6.

Specifically, according to a variation of the invention illustrated, the mechanisms for moving the cylinder needles comprise two jacks 70, 80 positioned in the same axial groove 4 of the cylinder 2, one below the other.

Figure 4A:
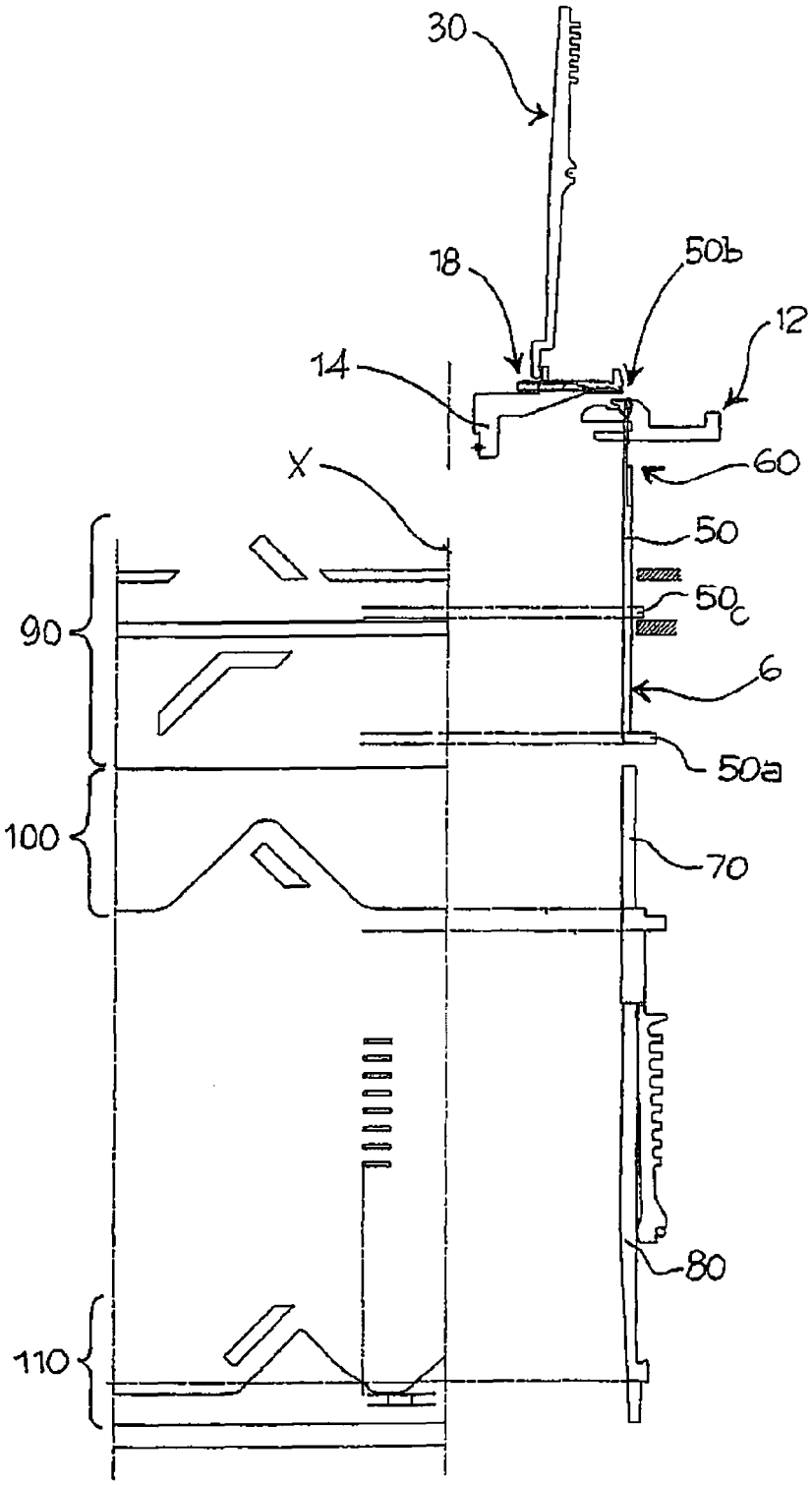
Figure 4B:
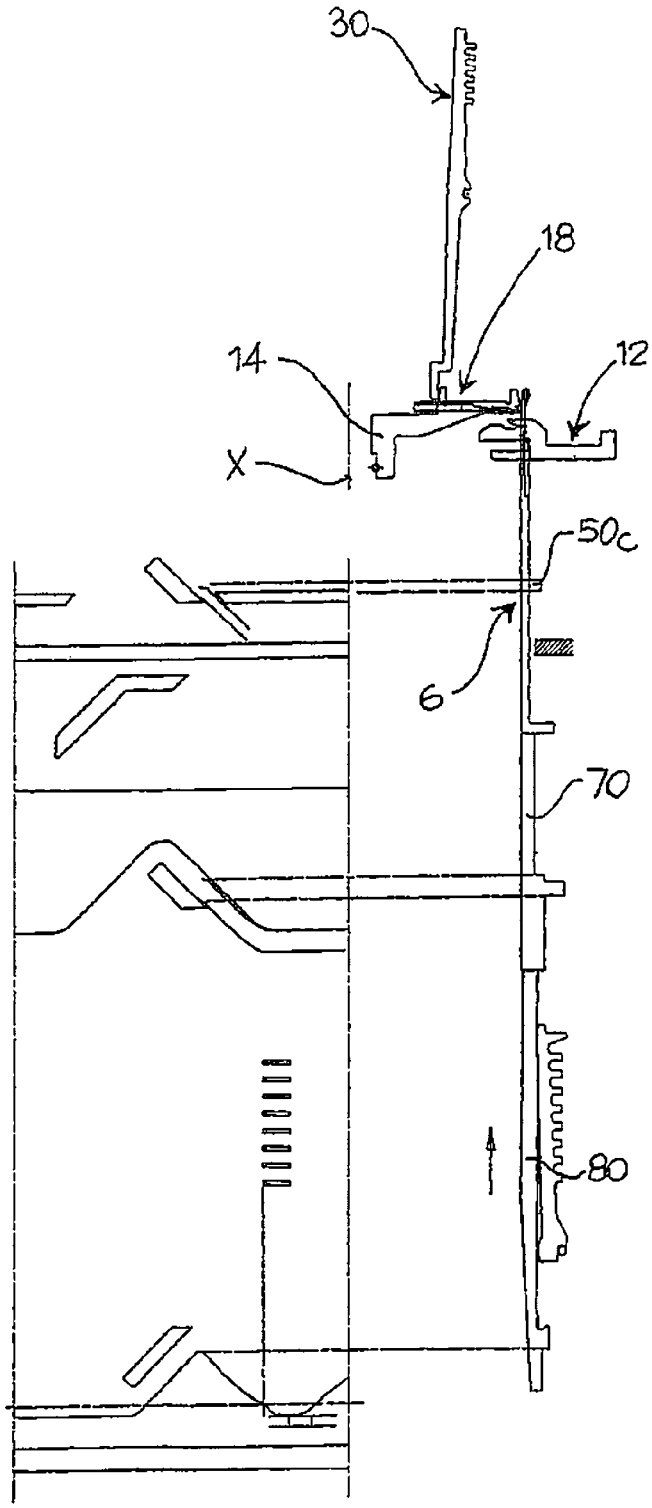
Figure 4C:
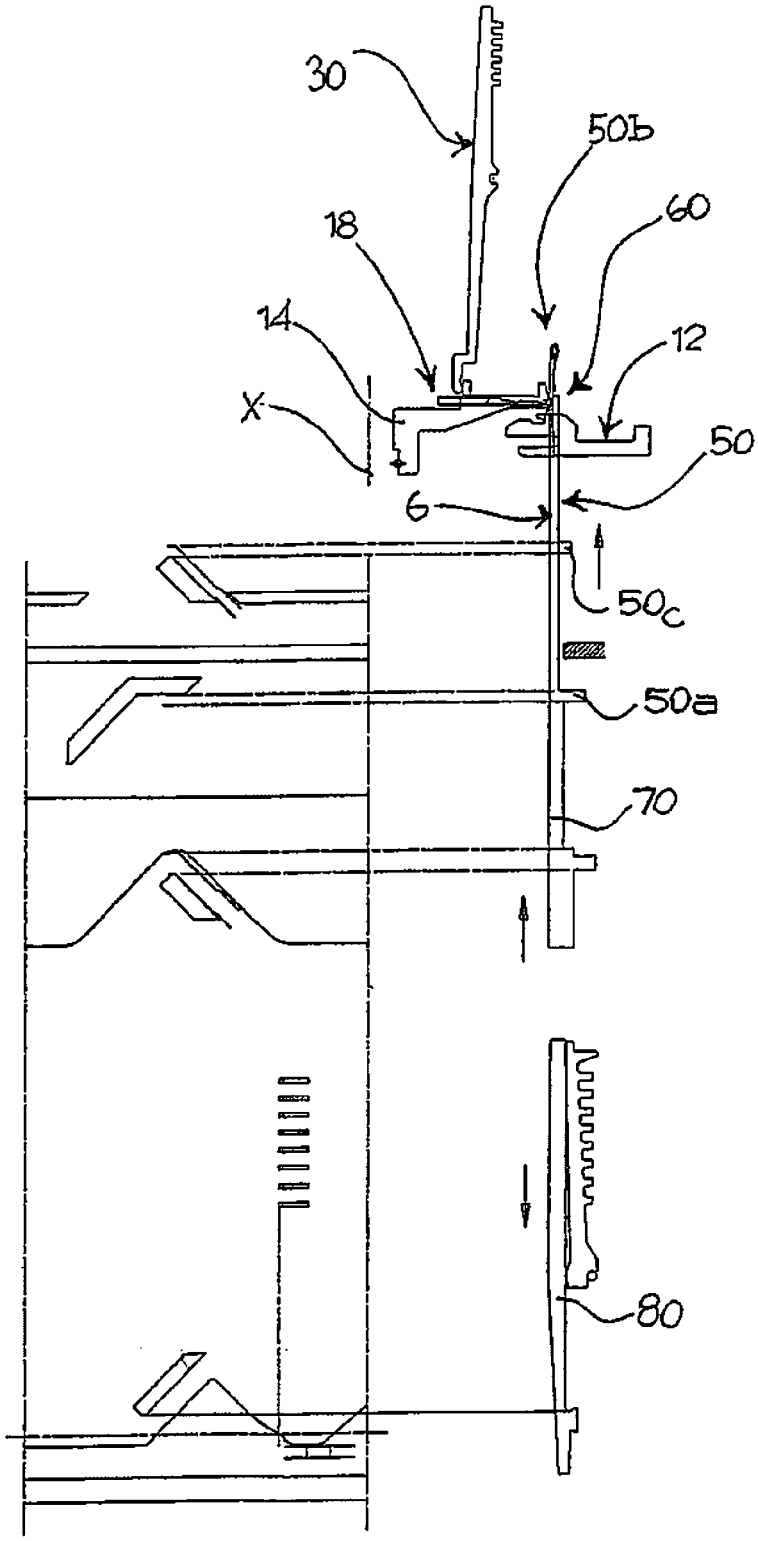
Figure 4D:
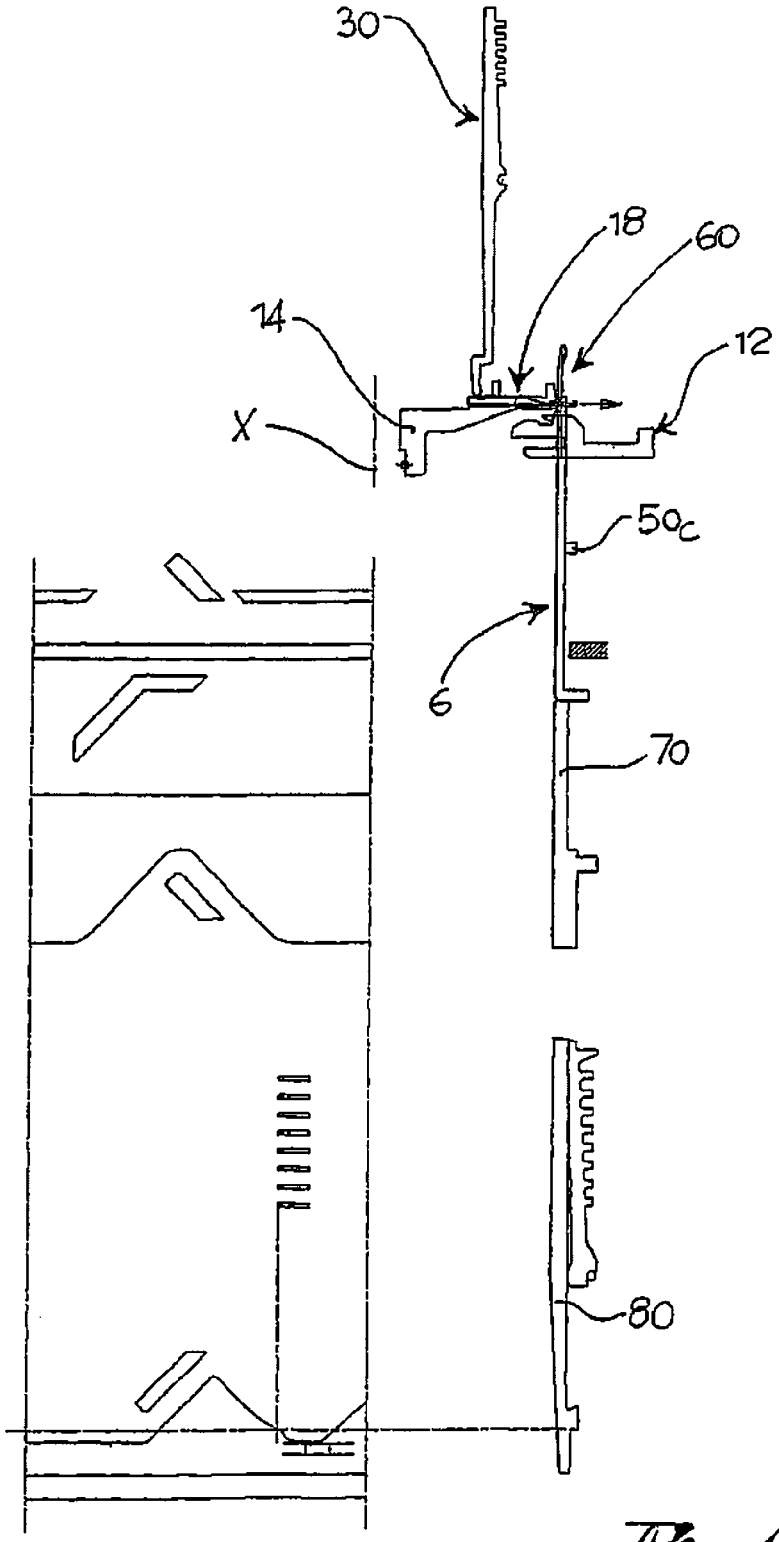
Figure 4E:
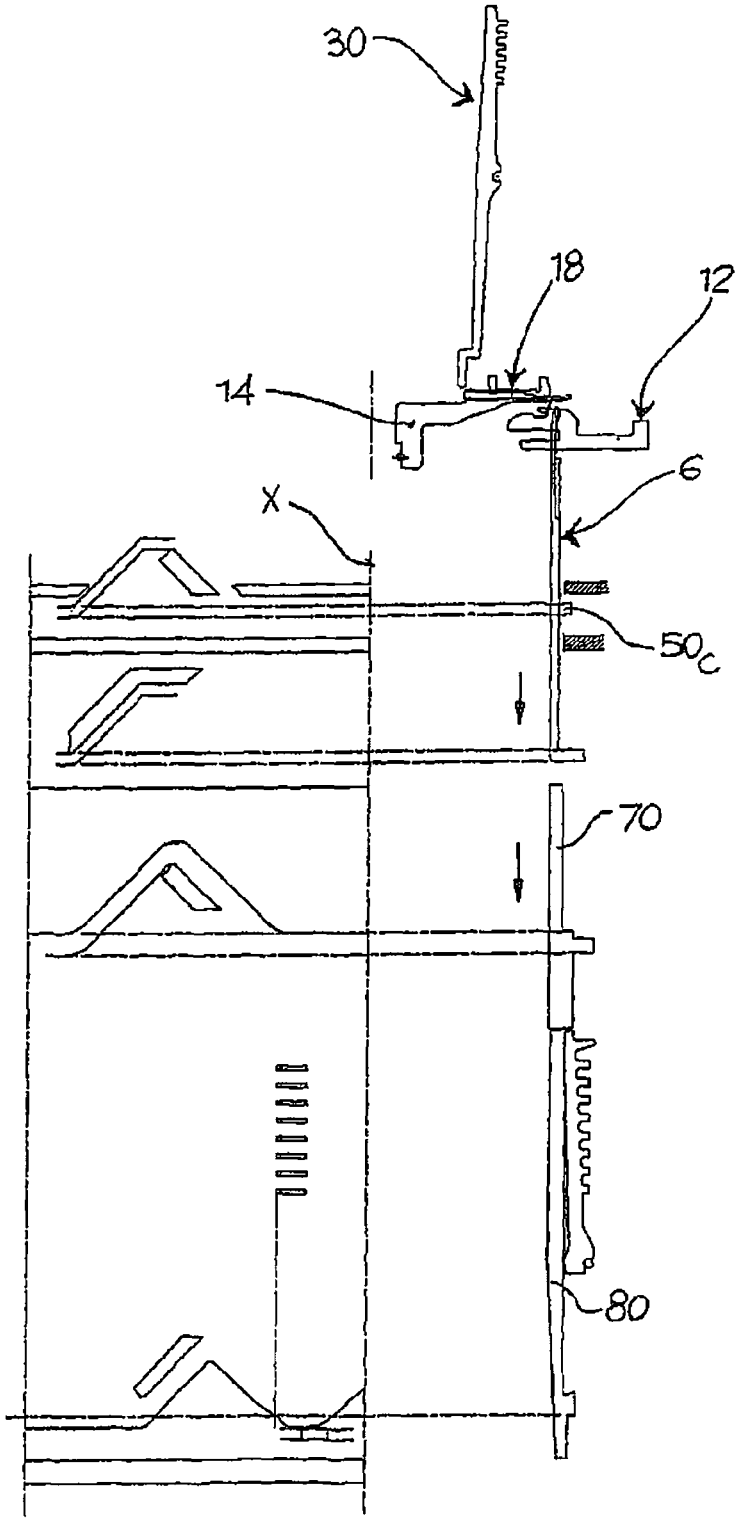
Figure 4F:
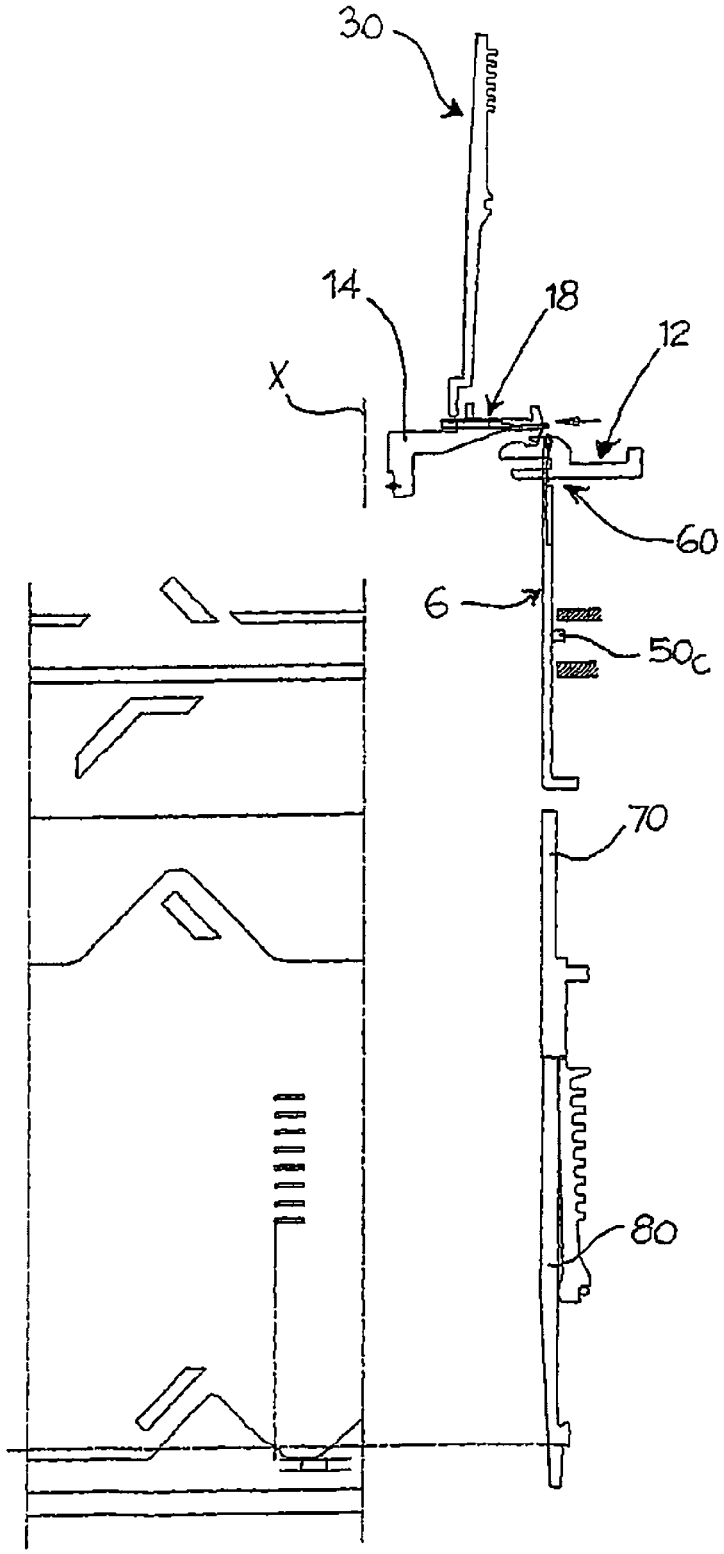

In addition, the mechanisms for moving the cylinder needles comprises a plurality of cam units, joined to the drum, in which a first unit 90 is able to engage the cylinder needles 6 only for translation and further units 100, 110 are able to engage the respective jacks 70, 80 for translation (FIG. 4*a*).

According to an embodiment variation, the mechanisms for moving the cylinder needles comprises an extremely steep cam which enables raising of the cylinder needle up to the position for transfer of the stitch from the cylinder to the dial.

Preferably, moreover, the machine 1 comprises suction means of traction, able to exert a pulling effect on the sock being formed, by means of a flow of air sucked inside the cylinder 2, which is hollow, from the top of it, where the dial is positioned, towards the bottom.

According to one embodiment variation, the machine 1 comprises mechanical means of traction, able to exert a pulling effect on the sock being formed by mechanical gripping of the sock being formed and pulling towards the bottom of the cylinder 2.

In other words, said mechanical means of traction are able to mechanically pinch the sock being formed and pull it towards the bottom of the cylinder, keeping it taut as required.

Innovatively, the machine according to the present invention makes it possible to accurately and simply select the dial needles to involve in the machining.

Advantageously, moreover, the machine according to the present invention makes it possible to perform stitch formation processes with transfer of the stitch from the cylinder to the dial and vice versa, even repeatedly during the production of a single sock, as required.

According to such advantageous aspect, the mechanisms for moving the cylinder needles make it possible to obviate the problem of axial space needed to raise the cylinder needle to the optimal height for the transfer of the stitch from the cylinder needle to the dial needle.

As may be imagined, the machine according to the present invention is able to perform a range of machining so broad as to include those types performed by double cylinder machines.

Advantageously, moreover, the machine according to the present invention makes it possible to pull the sock being formed harder than in the current known single cylinder machines for men's socks, so as to keep the sock taut even in the presence of machining of the stitch which would tend to wrinkle it.

It is clear that a person skilled in the art may make modifications to the machine described above so as to satisfy contingent and specific requirements, all moreover contained within the scope of protection as defined by the appended claims.

The invention claimed is:

1. A single cylinder circular knitting machine for making men's socks comprising:

a cylinder having a rotation axis, rotating in a controllable manner around said axis, and having a number of axial grooves on an outer surface;

a plurality of cylinder needles, lodged so as to slide along said axial grooves of the cylinder;

movement devices of the cylinder needles, suitable to impose on the cylinder needles a translation in alternate directions between a lower limit position and an upper limit position, axially higher than the lower limit position;

an outer fixed crown, which surrounds the cylinder, coaxial to it, fitted with a number of crown grooves;

a number of sinkers, lodged so as to slide along said crown grooves;

movement devices of the sinkers, able to impose a translation on the sinkers in alternate directions between a rearward limit position and a forward limit position, radially inside the rearward limit position;

a dial, positioned so as to surmount the cylinder, coaxial to it, and which can be made to rotate around the rotation axis of the cylinder, fitted with a number of radial grooves, which extend radially inside the outer surface of the cylinder;

a dial shaft, connected to the dial to drag it in rotation;

a plurality of dial needles, lodged so as to slide along said radial grooves of the dial, said dial needles being equal in number to the cylinder needles;

a mechanism for moving the dial needles, which can engage with said dial needles and able to impose a translation of the dial needles in alternate directions, between a rearward limit position and a forward limit position, radially external to the rearward limit position;

at least one yarn-finger able to feed at least one yarn for the production of the sock;

wherein the cylinder needles, the dial needles and the sinkers work together to interweave the yarn and form the stitches which constitute the sock;

dial needle selector mechanisms able to selectively move the dial needles to translate them from a disengaged position to an engaged position, in which they can be engaged by said mechanisms for moving the dial needles, involving the selected needles in the formation of the stitches and excluding the needles not selected, wherein the dial needle selector mechanisms comprise a number of selector rods oscillating upon command, which can engage with the dial needles so as to select at least some of them, said rods being limited in both directions radially to the respective dial needles.

2. The machine according to claim 1, wherein the rods are hinged to the respective dial needles.

3. The machine according to claim 2, wherein the rod ends in a tail protruding radially from an extremity, said tail terminating in a disc;

the dial needle has, at a heel, a seat, which the disc is housed in so as to rotate.

4. The machine according to claim 1, wherein the selector devices comprise selector command devices able to selectively move at least some of said selector rods to select the dial needles.

5. The machine according to claim 1, wherein the dial needles comprise a machining section for the creation of the stitch and a moving section, which can engage with the mechanism moving the dial needles; and wherein the moving sections of the dial needles are staggered axially.

6. The machine according to claim 1, comprising an uptwister, positioned so as to surmount the dial, coaxial with the rotation axis;

and wherein the mechanism for moving the dial needles comprise a plurality of cams, said cams being housed on said uptwister, between the uptwister and the dial.

7. The machine according to claim 1, comprising, in addition, a cutting device, positioned on the uptwister, able to cut the yarn.

8. The machine according to claim 1, wherein the cylinder needles comprise a) a spindle extending mainly along the rotation axis, between a lower extremity which can be made to slide by the mechanism for moving the cylinder needles, and an upper extremity, which can engage with the dial needles and the sinkers to form the stitch;

b) a hook and a tab, at the upper extremity of the spindle, said tab being pivoted at the spindle at a hinging point, so as to be reclosable onto said hook to make space for the yarn;

c) a transfer boss, projecting externally from the spindle, positioned below the hinging point, able to engage a stitch formed in the movement between the lower limit position and the upper limit position;

wherein the transfer boss is positioned along the spindle in such a way that, in the upper limit position of the cylinder needle, said transfer boss is above the machining extremity of the dial needle, to enable the transfer of the stitch from the cylinder to the dial.

9. The machine according to claim 1, wherein the cylinder is hollow inside, and said machine comprises a suction traction mechanism able to produce a flow of air aspirated from the upper extremity of the cylinder to the bottom of it, to suck down the sock being formed.

10. The machine according to claim 1, comprising a mechanical traction mechanism able to exert a pulling effect on the sock being formed by mechanical gripping of the sock being formed.

* * * * *